US006266835B1

(12) United States Patent
Henry et al.

(10) Patent No.: US 6,266,835 B1
(45) Date of Patent: Jul. 31, 2001

(54) PROCESS FOR DYEING BY DEPOSITING SPOTS OF DYEBATH ON MOVING FILAMENTS, BY CYCLIC INTERRUPTION OF SAID DEPOSIT, AND DEVICE FOR PRACTICING THIS PROCESS

(75) Inventors: Pierre Henry, Pfastatt; Philippe Massotte, Turckheim; Francois Saura, Mulhouse, all of (FR)

(73) Assignee: Superba S.A., Mulhouse (FR)

( * ) Notice: Subject to any disclaimer, the term of this patent is extended or adjusted under 35 U.S.C. 154(b) by 0 days.

(21) Appl. No.: 09/325,851

(22) Filed: Jun. 4, 1999

Related U.S. Application Data

(60) Provisional application No. 60/110,159, filed on Nov. 27, 1998.

(30) Foreign Application Priority Data

Jun. 16, 1998 (FR) ..... 98 07668

(51) Int. Cl.[7] ..... D06B 1/02
(52) U.S. Cl. ..... 8/149; 68/205 R
(58) Field of Search ..... 8/149; 68/205 R; 239/512, 517

(56) References Cited

U.S. PATENT DOCUMENTS 3,570,275 * 3/1971 Weber et al. ..... 68/205 R
4,015,550 4/1977 Bartenfeld et al. .
4,033,153 * 7/1977 Ahrweiler et al. ..... 68/205 R
4,047,271 * 9/1977 Paterson et al. ..... 8/149 X
4,254,644 * 3/1981 Bartlett et al. ..... 68/205 R
4,783,977 * 11/1988 Gilpatrick ..... 68/205 R

FOREIGN PATENT DOCUMENTS 2178339 11/1973 (FR) .
2 240 312 3/1975 (FR) .
2333883 7/1977 (FR) .
2 719 058 10/1995 (FR) .
2 059 876 4/1981 (GB) .

* cited by examiner

*Primary Examiner*—Philip R. Coe
(74) *Attorney, Agent, or Firm*—Young & Thompson

(57) ABSTRACT

A process of dyeing by deposition of spots of dyebaths of different colors on moving filaments, in a series of application stations, by abrupt cyclic or pseudo-random interruption of the deposition in the application stations, and a device for practicing this process. The process is characterized in that, in each application station, the moving filaments are abruptly taken out of contact with the dyebath by a linear or pseudo-linear actuating device acting on the dyebaths or on the moving filaments. The invention is more particularly applicable to the field of the textile industry, in particular the treatment of filaments, particularly by dyeing of the "spaced dyeing" type.

20 Claims, 3 Drawing Sheets

Fig-7
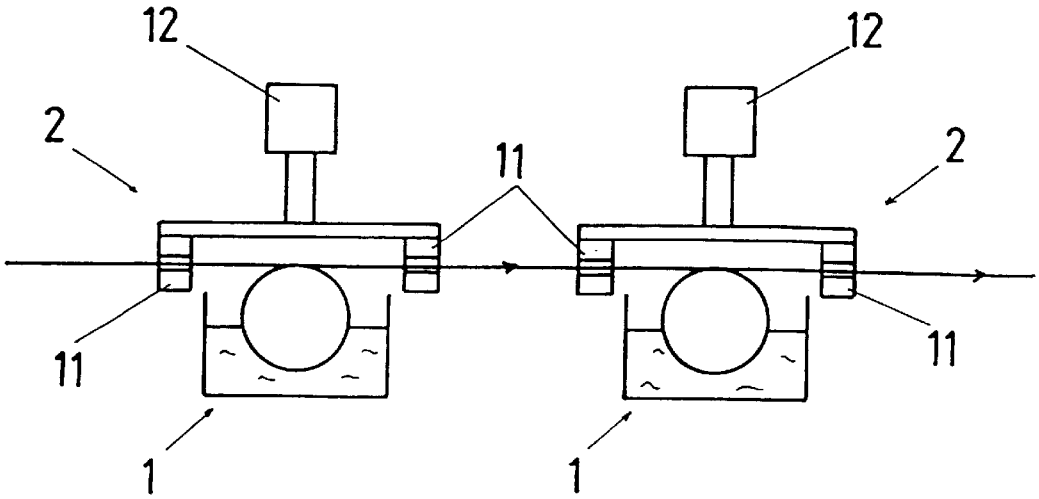
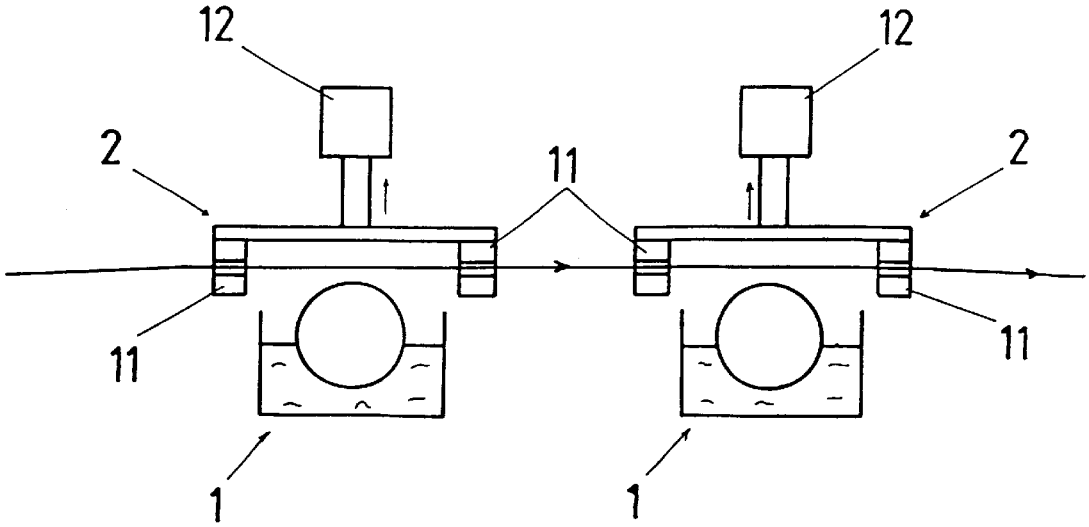
Fig-8

PROCESS FOR DYEING BY DEPOSITING SPOTS OF DYEBATH ON MOVING FILAMENTS, BY CYCLIC INTERRUPTION OF SAID DEPOSIT, AND DEVICE FOR PRACTICING THIS PROCESS

This application claims benefit of Provisional Application 60/110,159 filed Nov. 27, 1998.

FIELD OF THE INVENTION

The present invention relates to the field of textile industry, in particular the treatment of filaments, particularly by dyeing filaments and has for its object a process for dyeing by depositing spots of dyebath of different colors on moving filaments, in a series of application stations, by cyclic or semi-random interruption of said deposition in said application stations.

The invention also has for its object a device for practicing this process.

BACKGROUND OF THE INVENTION

The textile filaments are generally subjected, before their use, particularly for weaving, to washing and/or bleaching treatments as well as dyeing.

To this end, the dyeing is particularly carried out in moist condition by means of machines with one or several application stations, which are traversed by the filaments of a layer of filaments to be died.

In known application stations, particularly from FR-A-2 650 311 and FR-A-2 693 486, as well as U.S. Pat. Nos. 5,339,658 and 5,594,968, the filaments are subjected to successive impregnations by spots, commonly called "spaced dyeing" by cyclic or semi-random interruption of the application of the dyestuff.

Such an interruption can be carried out by acting on the means for supplying the dyebath, namely by provision of an applicator of the turbine type delivering radial jets or an application with contact rollers co-acting with rotatable means for cyclic or semi-random application of the filaments to said rollers, or else by a provision of an applicator of the nozzle type co-acting with the movable closure member, for example in the form of a disc provided with at least one calibrated slot for passage of the dyestuff. This latter embodiment is particularly known from FR-A-2 719 058.

Machines provided with application heads generally satisfy all the requirements of quality. However, their treatment capacity is limited, either to a number of filaments corresponding in width to a layer formed at the maximum length of the closure member, in the case of an applicator of the nozzle type co-acting with a movable closure member in the form of a disc provided with at least one calibrated slot, or to a maximum speed of movement of the filaments, in the case of application by contact with contact rollers co-acting with rotatable means for cyclic application of the filaments against said rollers, because of the inertia of the rotatable actuators.

As a result, an increase in output is not possible except by increasing the internal volume of the application heads. Such a solution is however not suitable, for obvious reasons of the size of the application heads involving the corresponding over-dimensioning of the assembly of the machine.

Thus, the processes and devices for dyeing by application of spots, commonly called "spaced dyeing", do not permit the provision of spots of relatively short length except by changing the speed of movement of the filaments, compensating the inertia of the cyclic closure means for application of the dyestuff, or the rotatable actuators of the rotatable means for cyclic application of the filaments against the contact rollers.

SUMMARY OF THE INVENTION

The present invention has for its object to overcome these drawbacks by providing a process and device for dyeing by deposition of spots of dyebath of different colors on moving filaments, in a series of application stations, by cyclic or pseudo-random interruption of said deposition in said application stations, permitting either obtaining spots of very short length for a given speed of movement, or a substantial increase of said speed of movement for a preestablished length of spot, and thus a corresponding improvement of output.

To this end, the process is characterized in that, in each application station, the filaments are placed out of contact with the dyebath by a linear or pseudo-linear actuating means acting on said dyebath or on said moving filaments.

The invention also has for its object a device for practicing this process, comprising a series of application stations, in each of which are successively applied spots of dyebath by means of dyebath applicators and devices for the cyclic or pseudo-random interruption of the deposition of said baths, characterized in that said cyclic or pseudo-random interruption devices of the deposition of the dyebath comprise linear or pseudo-linear actuators acting on said dyebaths or on said moving filaments.

BRIEF DESCRIPTION OF THE DRAWINGS

The invention will be better understood from the following description, which relates to preferred embodiments, given by way of non-limiting examples, and explained with reference to the accompanying schematic drawings, in which:

FIGS. 7 and 8 are views similar to those of FIGS. 1 and 2 of another modified embodiment of the invention, showing two successive dyestuff application stations.

DETAILED DESCRIPTION OF THE PREFERRED EMBODIMENTS

FIGS. 1 to 6 of the accompanying drawing show schematically a dyestuff application station, by a deposition of the dyestuff on moving filaments, particularly for a treatment of the "spaced dyeing" type, in which said deposition of dyebath on the moving filaments is carried out in a treatment chamber, not shown, by means of a dyebath applicator 1 co-acting with a device 2 for cyclic or pseudo-random interruption of the deposition of the dyebath. In these embodiments, the applicator 1 for the dyebath is in the form of a nozzle, a turbine or a device for projection of a jet of dyestuff. FIGS. 7 and 8 show another embodiment for application, according to which the moving filaments are placed into contact in each application station, with a contact roller forming the applicator 1 of the dyebath by means of a device 2 for cyclic or pseudo-random interruption of the deposition of said dyebath.

To use a dye process by deposition of spots of dyebath of different colors on moving filaments, a series of application stations thus equipped is disposed along the path of the moving filaments, so as to provide in each station a cyclic or pseudo-random application of spots of different colors.

According to the invention, in each application station, the moving filaments are placed into contact with the dyestuff bath by linear or pseudo-linear actuating means acting on said dyebath or on said moving filaments.

To this end, a device for practicing this process, comprising a series of application stations, in each of which are successively applied spots of dyebath by means of dyebath applicators 1 and devices 2 for cyclic or pseudo-random interruption of the deposition of said baths, is characterized in that said cyclic or pseudo-random interruption devices 2 of the deposition of the dyebaths comprise linear or pseudo-linear actuators acting on said dyebaths or on the moving filaments.

Figure 1:
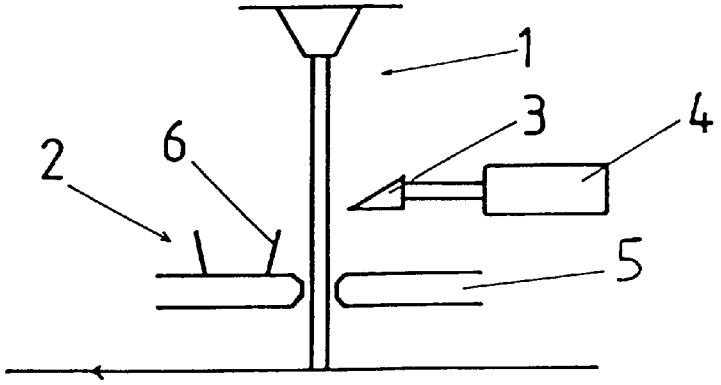
FIG. 1 is a schematic view of a dyebath application station according to the invention, in the service position.
Figure 2:
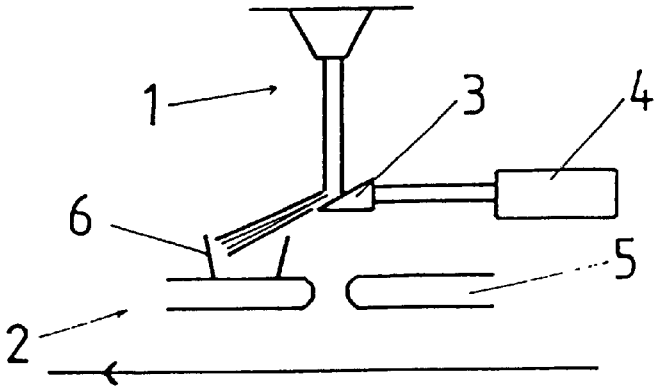
FIG. 2 is a view similar to that of FIG. 1, in the position of interruption of service.

As shown more particularly in FIGS. 1 and 2 of the accompanying drawings, according to a first embodiment of the invention involving application stations provided with applicators 1 in the form of nozzles, turbines or devices for projecting or spraying co-acting with a means 5 for guiding and limiting the width of the jet of dyebath, each device 2 for cyclic or pseudo-random interruption of the deposition of the dyebath is preferably constituted by a blade 3 extending in the service position, which is to say during deposition of the dyebath, perpendicularly to the jet of dyebath, and hence parallel to the direction of movement of the filaments, this blade 3 being connected, either directly, or by means of a mechanical movement amplifier (not shown), with an output rod of a linear or pseudo-linear actuator 4 and deflecting said jet into a reception vessel 6 disposed on the opposite side relative to said jet, above the means 5 for guiding and limiting the width of the jet of dyestuff.

Thus, during application of the dyebath, the blade 3 remains in the retracted position shown in FIG. 1 of the accompanying drawings. An interruption of the jet of dyestuff is effected, as shown in FIG. 2, by moving the linear or pseudo-linear actuator 4, which has the result of extending its rod and moving the blade 3 into the path of the jet of dyestuff, which is thus deflected into the reception vessel 6, without being able to reach the moving filaments. The possible provision of mechanical movement amplifying means permits obtaining a sufficiently great movement of the blade 3, whilst using actuators of only short or very short path of movement, hence of small size.

Figure 3:
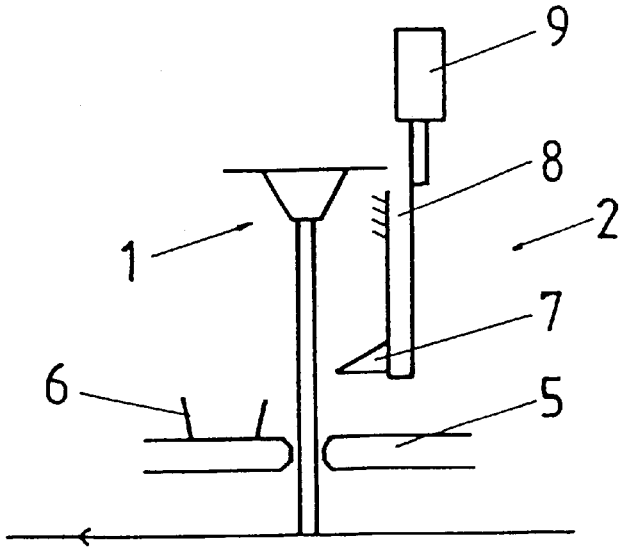
FIGS. 3 and 4 are views analogous to those of FIGS. 1 and 2, of a modified embodiment of the invention.
Figure 4:
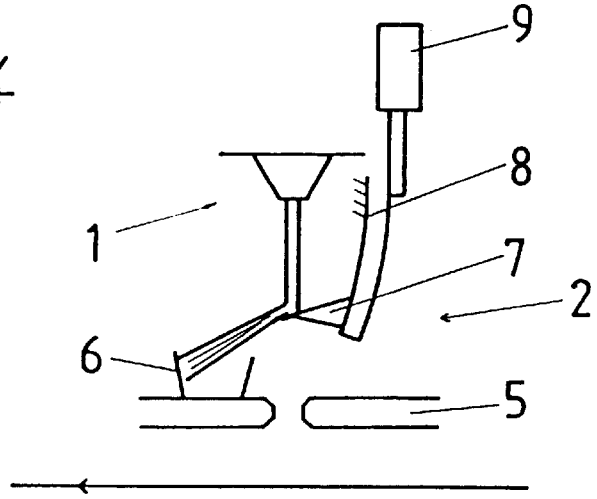

FIGS. 3 and 4 of the accompanying drawings show a modified embodiment of the invention, also applicable to application stations provided with applicators 1 in the form of nozzles, turbines or projection or spraying devices, coacting with a means 5 for guiding and limiting the width of the jet of dyestuff, in which each device 2 for cyclic or pseudo-random interruption of the deposition of the dyebath is constituted by bar 7 mounted on a deformable device, such as the free end of a two-strip arm 8, or the like, of which one portion is secured to the infrastructure of the application station and whose other part co-acts with a rod of the linear or pseudo-linear actuator 9 to deflect the jet of dyestuff, from the opposite side relative to said jet, into a reception vessel 6 disposed above the means 5 for guiding and limiting the width of said jet. This embodiment permits positioning the actuator 9 within the vertical space of the application station, such that the lengthwise dimension of the station can be reduced, which is particularly advantageous with a series of stations, the total length of an application machine being accordingly thus reduced.

In the case of an embodiment according to FIGS. 3 and 4, controlling the actuator 9 is effected by pressing on the blade of the arm 8 which is secured to the actuator rod and, because the other blade is maintained rigid, this arm 8 is subjected to deformation by flexing, having as a result a displacement of the bar 7 into the path of the jet of dyestuff, which is thus deflected toward the reception vessel 6, such that the moving filament is not impregnated with dyestuff. In this embodiment, the device 2 is in the form of an actuator co-acting with a deformable device in the form of a double blade. Of course, it is also possible to embody this deformable device in another form, namely a strip, an element resiliently deformable by twisting, or the like.

According to a modified embodiment of the invention, not shown in the accompanying drawings, each device 2 for cyclic or pseudo-random interruption of the deposition of dyebath could be constituted by a bar 7 mounted on a deformable device, such as a piezoelectric flexible actuator. Such an actuator, known as a "bender", deforms under an electric charge, to produce a flexure which moves the bar 7 into the path of the jet of dyestuff, deflecting the latter out of the path of the moving filament. A schematic representation of such an actuator would correspond substantially to that of the double blade of FIGS. 3 and 4 of the accompanying drawings. Thus, the electrical supply of the piezoelectric flexible actuator would have the effect of giving rise to a displacement of its bar 7 for interrupting the jet in this latter, preventing dyeing of the moving filament during the duration of this electrical supply. Of course, such an actuator could also operate in the reverse manner, which is to say it could interrupt the jet of dyestuff when it is not actuated, at the same time that its electrical supply would permit said dyeing by retraction of the bar 7 out of the path of the jet.

According to another modified embodiment of the invention, not shown in the accompanying drawings, the device 2 for cyclic or pseudo-random interruption of the deposition of dyebath could also be present in the form of a flap extending parallel to the jet of dyestuff, whose pivotal axis is parallel to the jet and to the plane of the moving filaments and which is provided with an actuating lever co-acting with the output rod of the linear or pseudo-linear actuator. In such a case, the linear or pseudo-linear actuator could extend perpendicular to the flap or parallel to this latter, as a function of a positioning of the lever in prolongation of said flap or perpendicular to the latter. The operation of such a device 2 is identical to that described with respect to the embodiment of FIGS. 3 and 4, the flexural movement being simply replaced by pivotal movement.

Figure 5:
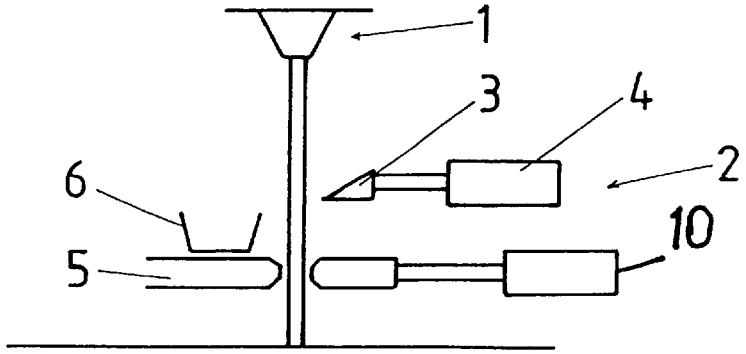
FIGS. 5 and 6 are views similar to those of FIGS. 1 and 2, of a third modification of the invention.
Figure 6:
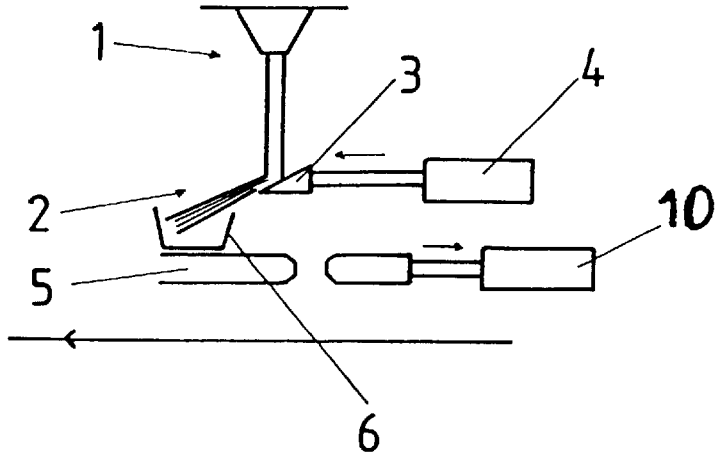

FIGS. 5 and 6 show another modified embodiment of the invention, in which the device 2 for cyclic or pseudo-random interruption of the deposition of dyebath comprising a blade 3, a bar or flap connected to a linear or pseudo-linear actuator 4, co-acts with a guide means 5 for a limitation of the width of the jet of dyestuff movable parallel to the moving filaments and moved in the direction opposite that of the device 2, by another linear or pseudo-linear actuator 10. Thus, it is possible to carry out simultaneously a deflection of the jet of dyestuff by means of the device 2, and a displacement of the means 5 for guiding and limiting the width of the jet, such that the speed of interruption of the application of the jet of dyebath can be increased.

It is also possible, according to another modified embodiment of the invention not shown in the accompanying drawings, to provide the device 2 for cyclic or pseudo-random interruption of the deposition of dyebath, directly in the form of a means 5 for guiding and limiting the width of the jet of dyebath, constituted by two plates movable one in the direction of the other to close totally the passage opening for the jet in the interruption position, each plate being controlled individually by a linear or pseudo-linear actuator.

The process according to the present invention is applicable also in the case of application carried out by contact, in each application station, between the moving filaments and a contact roller forming the applicator 1 for the dyebath, by means of a device 2 for cyclic or pseudo-random interruption of the deposit of said dyebath, as shown in FIGS. 7 and 8 of the accompanying drawings. This device 2 is thus present, for each contact roller, in the form of a pair of lateral guides 11 for the moving filaments, these guides 11 extending on opposite sides of a contact roller and being connected to at least one end of a transverse connecting member to an output rod of a linear or pseudo-linear actuator 12.

The lateral guides 11 are preferably in the form of combs in two portions lowerable or receivable on each other and defining a service position of the individual folds for passage of the filaments of a diameter corresponding to that of said filaments.

This embodiment permits raising the filaments out of contact with the corresponding contact roller independently of the position of said filaments in the preceding and following application stations, and this so as to promote obtaining the very short spots.

According to another modified embodiment of the invention, not shown in the accompanying drawings, the device 2 for cyclic or pseudo-random interruption of the deposition of dyebaths could also be constituted by at least one nozzle for the projection of air, perpendicularly or at a bias relative to the jet of dyebath, or to the layer or moving filaments above the contact rollers, the opening and closing of the nozzle or nozzles being controlled by means of one or several corresponding linear or pseudo-linear actuators. Thus, each triggering of the air projection nozzle or nozzles would have the effect of deflecting the jet or dyebath toward the receiving vessel for re-utilization of the dyebath, by return toward the supply reservoir, or a deflection of the filaments out of contact with the corresponding contact roller.

Air jet projection nozzles are known for various applications, particularly for directional blowing, and are not described in detail. The nozzles used by the present invention are preferably flat jet nozzles of a width corresponding to the dimension of the jet of dyebath to be interrupted, particularly in the direction of movement of the filaments, or to the width of the layer of filaments to be spaced from the corresponding contact roller.

Preferably, the linear or pseudo-linear actuators 4, 9, 10 and 12 are linear electrical motors, piezoelectric actuators or else electromagnetic actuators, provided or not with mechanical movement amplification means, controlled entirely or not at all or in a proportional manner by means of a corresponding electronic device.

The assembly of the electronic control devices for the individual actuators 4, 9, 10 and 12 in the different application stations, is controlled by central computer means according to a program defining the change in repetition of the successive spots of color deposited in the application stations. Such a computer control means is known per se and does not require description in detail. The mentioned actuators have ultra-rapid response times, namely of the order of several fractions of a millisecond, such that the lengths of the spot can be considerably reduced.

Thanks to the invention, it is possible to provide a process and device for dyeing by deposition of spots of dyebath of different colors on moving filaments of the "spaced dyeing" type, in a series of application stations, by cyclic or pseudo-random interruption of said deposition in said application stations, this interruption taking place in each station in an independent manner.

Moreover, because of the use of linear or pseudo-linear control means with extremely short reaction times, the interruption of the application of dyebath can be carried out very rapidly and the color spots on the filaments can be of short length relative to those obtained by processes known until now.

Finally, the use of linear or pseudo-linear actuators, whose operation is very short and can be subject to wear, permits limiting the maintenance cycle of the interruption means for application, thereby giving rise to corresponding increases in output in use.

Of course, the invention is not limited to the embodiments described and shown in the accompanying drawings, modifications remain possible, particularly as to the construction of the various elements or by substitution of technical equivalents, without thereby departing from the scope of protection of the invention.

What is claimed is:

1. A spaced dyeing apparatus, comprising:

a series of application stations at each of which are successively applied spots of dyestuff to filaments to be dyed;

each said station comprising a dye applicator means for providing a jet of dyestuff and an interruption device for interruption of dyeing by said dye applicator means;

said interruption device comprising a linear actuator, a deformable two-strip arm, and a bar mounted on a free end of said two-strip arm;

means for guiding and limiting the width of the jet of dyestuff;

a reception vessel disposed above said guiding and limiting means, and disposed on an opposite side of said jet to said interruption device;

a portion of said two-strip arm being secured to an infrastructure of the respective station; and said actuator having a rod which co-acts with another portion of said two-strip arm to cause said bar to deflect the jet of dyestuff into said reception vessel.

2. A spaced dyeing apparatus, comprising:

a dye applicator for providing a jet of dyestuff;

an interruption device deformable by flexing to intercept and deflect said jet; and said interruption device comprising a piezoelectric actuator for effecting said flexing.

3. The apparatus of claim 2, wherein said interruption device comprises a two-strip arm.

4. The apparatus of claim 3, wherein said arm extends substantially parallel to said jet, a bar for intercepting said jet is mounted at one end of said arm, and said actuator is located at an opposite end of said arm.

5. The apparatus of claim 2, wherein said jet is directed downwardly, said interruption device comprises a flexible arm extending substantially parallel to said jet with a bar mounted on a lower end of said flexible arm, and said actuator operates to flex said flexible arm.

6. The apparatus of claim 2, wherein said interruption device comprises a flexible arm having a lengthwise direction, and said actuator operates in said lengthwise direction to effect said flexing.

7. The apparatus of claim 6, wherein said arm carries a bar directed towards said jet to intercept said jet.

8. The apparatus of claim 2, further comprising means for guiding and limiting the width of said jet.

9. The apparatus of claim 8, wherein said jet is directed downwardly, said interruption device comprises a flexible arm extending along but to one side of said jet, and said guiding and limiting means is located below said dye applicator and said interruption device.

10. A spaced dyeing apparatus, comprising:

a series of application stations for spaced dyeing of filaments;

each application station comprising:

(a) a nozzle for directing a jet of dyestuff downwardly;

(b) an interruption device capable of flexing to intercept and deflect said jet; and (c) said interruption device comprising a lengthwise extending two-strip arm in combination with a linear actuator, actuation of said actuator in a lengthwise direction of said arm causing said arm to flex.

11. The apparatus of claim 10, wherein:

said two-strip arm extends alongside said jet;

one of said two strips is mounted on an infrastructure of the respective application station; and said linear actuator is distinct from said two-strip arm and operates on the other of said two strips to flex said two-strip arm.

12. The apparatus of claim 10, wherein said linear actuator comprises a piezoelectric actuator.

13. A spaced dyeing apparatus comprising:

a series of dyeing stations for forming spots of dyestuff of different colors on moving filaments;

each said station comprising dye applicator means for deposition of said dyestuff, and interruption means for interrupting said deposition; and said interruption device comprising a piezoelectric actuator capable of effecting a flexing motion and operatively connected to a bar to move said bar due to said flexing motion between a position allowing said deposition and a position interrupting and diverting said deposition.

14. The apparatus of claim 13, wherein said interruption device includes a member connected between said actuator and said bar.

15. The apparatus of claim 13, wherein said interruption means comprises a two-strip arm extending in a longitudinal direction, said actuator functioning on said arm in said longitudinal direction to effect said flexing.

16. The apparatus of claim 13, wherein said piezoelectric actuator is a deformable piezoelectric flexible actuator.

17. Apparatus for dyeing by deposition of spots of dyebaths of different colors on moving filaments, comprising:

a series of application stations;

said stations including dyebath applicators for successively applying said dyebaths to said filaments, and interruption devices for cyclic or pseudo-random interruption of said applying;

said dyebath applicators producing downwardly directed jets of dyebaths; and said interruption devices extending generally vertically and comprising deformable piezoelectric flexible actuators.

18. The apparatus according to claim 17, comprising means for controlling the piezoelectric actuators of the different application stations according to a program to define the deposition of successive color spots at the application stations.

19. A process of spaced dyeing filaments, comprising the steps of:

passing the filaments through a series of dyeing stations;

directing jets of dyestuffs of different colors downwardly towards said filaments to dye said filaments as said filaments pass through said dyeing stations;

diverting said jets to interrupt temporarily dyeing of said filaments to create a spaced dyeing effect on said filaments; and said diverting being effected by flexing of elements extending generally parallel to said jets.

20. The process of claim 19, wherein said flexing is effected by piezoelectric actuators.

* * * * *